US011383142B2

(12) United States Patent
Anousis et al.

(10) Patent No.: US 11,383,142 B2
(45) Date of Patent: Jul. 12, 2022

(54) FENCING TRAINING DEVICE AND METHOD OF USING THE SAME

(71) Applicants: Angelica Anousis, Quincy, MA (US); Maria Angela Theodore, Quincy, MA (US)

(72) Inventors: Angelica Anousis, Quincy, MA (US); Maria Angela Theodore, Quincy, MA (US)

( * ) Notice: Subject to any disclaimer, the term of this patent is extended or adjusted under 35 U.S.C. 154(b) by 192 days.

(21) Appl. No.: 16/826,808

(22) Filed: Mar. 23, 2020

(65) Prior Publication Data

US 2021/0291031 A1 Sep. 23, 2021

(51) Int. Cl.
*A63B 69/02* (2006.01)
*A63B 69/00* (2006.01)

(52) U.S. Cl.
CPC ..... *A63B 69/02* (2013.01); *A63B 69/0059* (2013.01)

(58) Field of Classification Search
CPC . A63B 69/0057; A63B 69/02; A63B 69/0059; A63B 69/0062; A63B 71/06; A63B 21/025
See application file for complete search history.

(56) References Cited

U.S. PATENT DOCUMENTS 3,680,869 A * 8/1972 Brady ..... A63B 69/0059 473/213
3,804,420 A * 4/1974 Boyd ..... A63B 69/0059 473/212
3,985,364 A * 10/1976 Brady ..... A63B 69/0059 473/213
5,131,684 A * 7/1992 Dandy, III ..... A63C 5/06 2/311
5,762,281 A 6/1998 Foley
6,458,036 B1 * 10/2002 Gutierrez ..... A63B 69/0059 473/207
6,871,812 B1 3/2005 Chang
7,731,597 B1 6/2010 Burgess
7,811,185 B1 * 10/2010 Reynolds ..... A63B 69/0057 473/453
8,052,548 B1 * 11/2011 Stanisic ..... A63B 69/0059 473/464
9,802,095 B1 * 10/2017 Boyer ..... A63B 69/0059
9,833,677 B2 12/2017 Ross
11,135,491 B2 * 10/2021 Gilardo ..... G09B 19/0038
2004/0097296 A1 * 5/2004 Snyder ..... A63B 69/3608 473/212
2008/0000432 A1 * 1/2008 Alhegelan ..... A01K 27/004 119/796
2008/0214319 A1 * 9/2008 Brooks ..... A63B 69/3614 473/215
2011/0183769 A1 * 7/2011 Sery ..... A63B 69/0059 473/213

(Continued)

FOREIGN PATENT DOCUMENTS

KR 101860799 B1 5/2018

*Primary Examiner* — John E Simms, Jr.
(74) *Attorney, Agent, or Firm* — Stevens & Showalter LLP

(57) ABSTRACT

A fencing training device including: a first part configured to be coupled to a fencing weapon; a second part configured to be coupled to a lower portion of a fencer's body; and a retractable connector disposed between the first and second parts. Also provided is a method of training a fencer to perform a lunge and a fencing training system for providing feedback to a fencer regarding improper technique.

18 Claims, 10 Drawing Sheets

(56) References Cited

U.S. PATENT DOCUMENTS

| | | | | |
|---|---|---|---|---|
| 2011/0250979 | A1* | 10/2011 | Dean | A63B 69/3632 473/207 |
| 2018/0260798 | A1* | 9/2018 | Bacallao | G06K 7/10881 |
| 2020/0353341 | A1* | 11/2020 | Djurisic | A63B 71/0669 |

* cited by examiner

FENCING TRAINING DEVICE AND METHOD OF USING THE SAME

FIELD OF THE INVENTION

The invention generally relates to sports training devices and methods, and more particularly to training devices and methods for fencing.

BACKGROUND OF THE INVENTION

In the sport of fencing, the lunge is one of the most common moves and can often be difficult for beginning fencers to learn. To perform a lunge, the fencer must first extend the weapon arm, after which the front leg moves forward and the fencer pushes off of the opposing leg. The weapon arm and front leg are on the same side of the fencer's body, such that the fencer must learn to use the arms and legs out of sync with a normal walking gait in which the arms move with the legs on the opposing side of the body. In addition, most people lead with the foot when preparing to move forward, and novice fencers must learn to lead with the weapon arm.

Many beginning fencers practice at home using one or more fencing training devices. These training devices typically focus on, for example, building strength and endurance (e.g., with elastic bands) and improving reaction time and accuracy. However, these training devices typically provide no feedback to the fencer regarding improper technique. Thus, there is a need for improved fencing training devices and method for teaching proper lunge form to beginning fencers and for identifying and correcting improper technique.

SUMMARY OF THE INVENTION

In accordance with an aspect of the present disclosure, a fencing training device is provided which includes: a first part configured to be coupled to a fencing weapon; a second part configured to be coupled to a lower portion of a fencer's body; and a retractable connector disposed between the first and second parts.

In accordance with another aspect of the present disclosure, a method of training a fencer to perform a lunge is provided, the method comprising: coupling a first part of a fencing training device to a fencing weapon; coupling a second part of the fencing training device to a front leg of the fencer, in which a retractable connector is disposed between the first and second parts of the fencing training device; and in response to (i) movement of one of the first or the second part away from the other of the first or the second part, or (ii) movement of the first and second parts away from each other, extending the retractable connector.

In accordance with a further aspect of the present disclosure, a fencing training system for providing feedback to a fencer regarding improper technique is provided, the fencing training kit including: a first part configured to be coupled to a fencing weapon; a second part configured to be coupled to a lower portion of a fencer; and a retractable connector disposed between the first and second parts, in which the fencing training system provides the feedback based on improper extension or retraction of the retractable connector.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
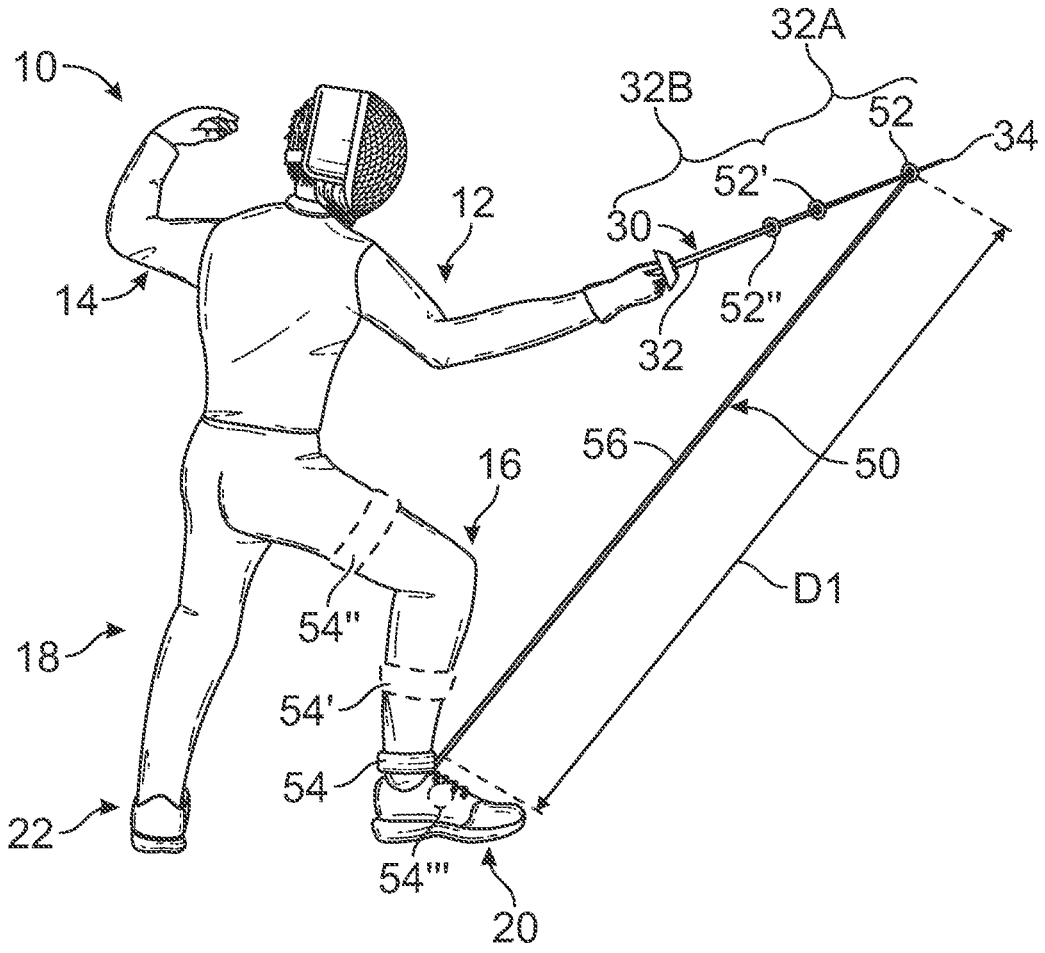
FIG. 1 is a side, perspective view of a fencer wearing a fencing training device in accordance with the present disclosure.

With reference to FIG. 1, a fencer 10 is depicted using a fencing training device 50 in accordance with the present disclosure. The fencer 10 holds a fencing weapon 30 with a weapon arm, which may be the fencer's right arm 12, as shown, or left arm 14 (not shown). The fencing weapon 30 depicted in FIG. 1 may represent any of the weapons commonly used in the sport of fencing, e.g., a foil, épée, or sabre. The fencing weapon 30 may comprise a sword with a blade 32, in which the blade 32 may comprise a forward section 32A and a rear section 32B.

Figure 5:
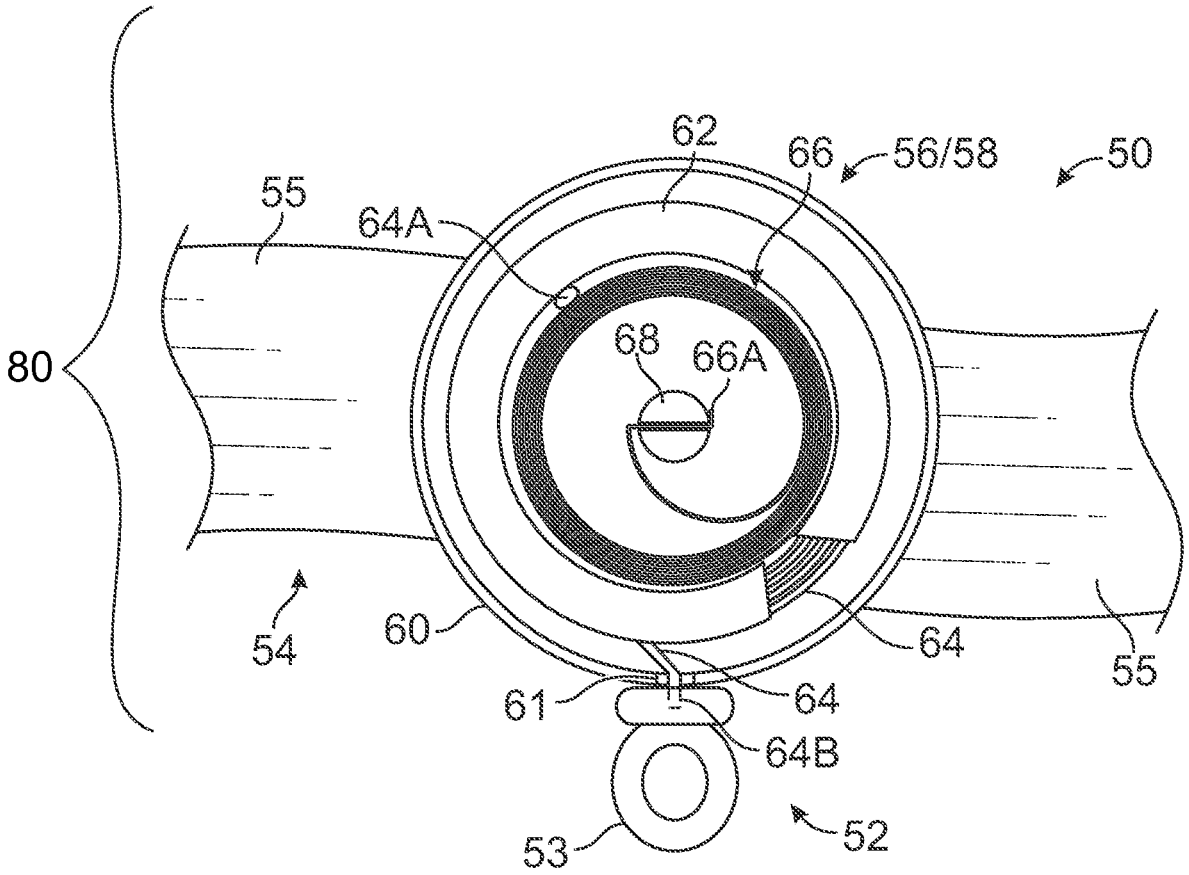
FIG. 5 is a schematic of a retractable connector in accordance with the present disclosure, in which the retractable connector is in a fully retracted, starting position.

As shown in FIGS. 1 and 5, the fencing training device 50 may comprise a first part 52; a second part 54; and a retractable connector 56 disposed between the first and second parts 52 and 54 of the fencing training device 50. The first part 52 of the fencing training device 50 may be configured to be coupled to the fencing weapon 30. In particular, the first part 52 may be configured to be coupled to the forward section 32A of the blade 32. The blade 32 comprises a tip 34, and in some examples, the first part 52 may be configured to be coupled to the blade 32 at or near the tip 34. As shown in FIG. 5, the first part 52 of the fencing training device 50 may comprise, for example, a ring or loop 53 that wraps around and/or over a portion of the fencing weapon 30. The first part 52 may optionally be secured to the fencing weapon 30 by, for example, an adhesive, a hook and loop fastener, or by one or more ties. In other examples, the first part 52', 52" of the fencing training device 50 may be configured to be coupled to other locations within the forward section 32A of the blade 32.

The second part 54 of the fencing training device 50 may be wearable and may be configured to be coupled to a lower portion of the fencer's body. In the example shown in FIG.

1, the lower portion of the fencer's body may comprise a leg portion, which may include a portion of the fencer's right leg 16 or an associated article of clothing worn by the fencer 10, e.g., a pants leg, sock, shoe, etc. For instance, the leg portion may comprise the fencer's right ankle (not separately labeled), and the second part 54 of the fencing training device 50 may be configured to be coupled to the fencer's right ankle. In other examples, the leg portion may comprise a part of the fencer's lower leg such as the calf (not separately labeled), e.g., second part 54'; a part of the fencer's upper leg such as the thigh (not separately labeled), e.g., second part 54"; or a part of the fencer's right foot 20, e.g., second part 54'''. As shown in FIGS. 1 and 5, the second part 54/54'/54"/54''' of the fencing training device 50 may comprise, for example, a band 55 of material that wraps around and/or over the fencer's ankle, calf, thigh, or foot 20. The band 55 may comprise a continuous band of elastic material or may be adjustable and may be secured via a buckle, one or more snaps, a hook and loop fastener, and the like (not shown). In other examples (not shown), the second part 54/54'/54"/54''' may comprise a clip, hook, or other attachment that allows the second part 54/54'/54"/54''' to be coupled to, for instance, a part of the fencer's clothing.

The fencer 10 depicted in FIG. 1 is right-handed and the fencer's weapon arm 12 and the leg portion to which the second part 54/54'/54"/54" of the fencing training device 50 is attached are both located on a same side, i.e., the right side, of the fencer's body. Although not shown, it is understood that the fencing training device 50 may also be used with left-handed fencers. For a left-handed fencer, the fencing weapon would be held with the left arm 14, and the leg portion to which the second part of the fencing training device would be coupled would comprise a portion of the fencer's left leg 18 or an associated article of clothing, such that the fencer's weapon arm 14 and leg portion are located on a same side, i.e., the left side, of the fencer's body.

Figure 6:
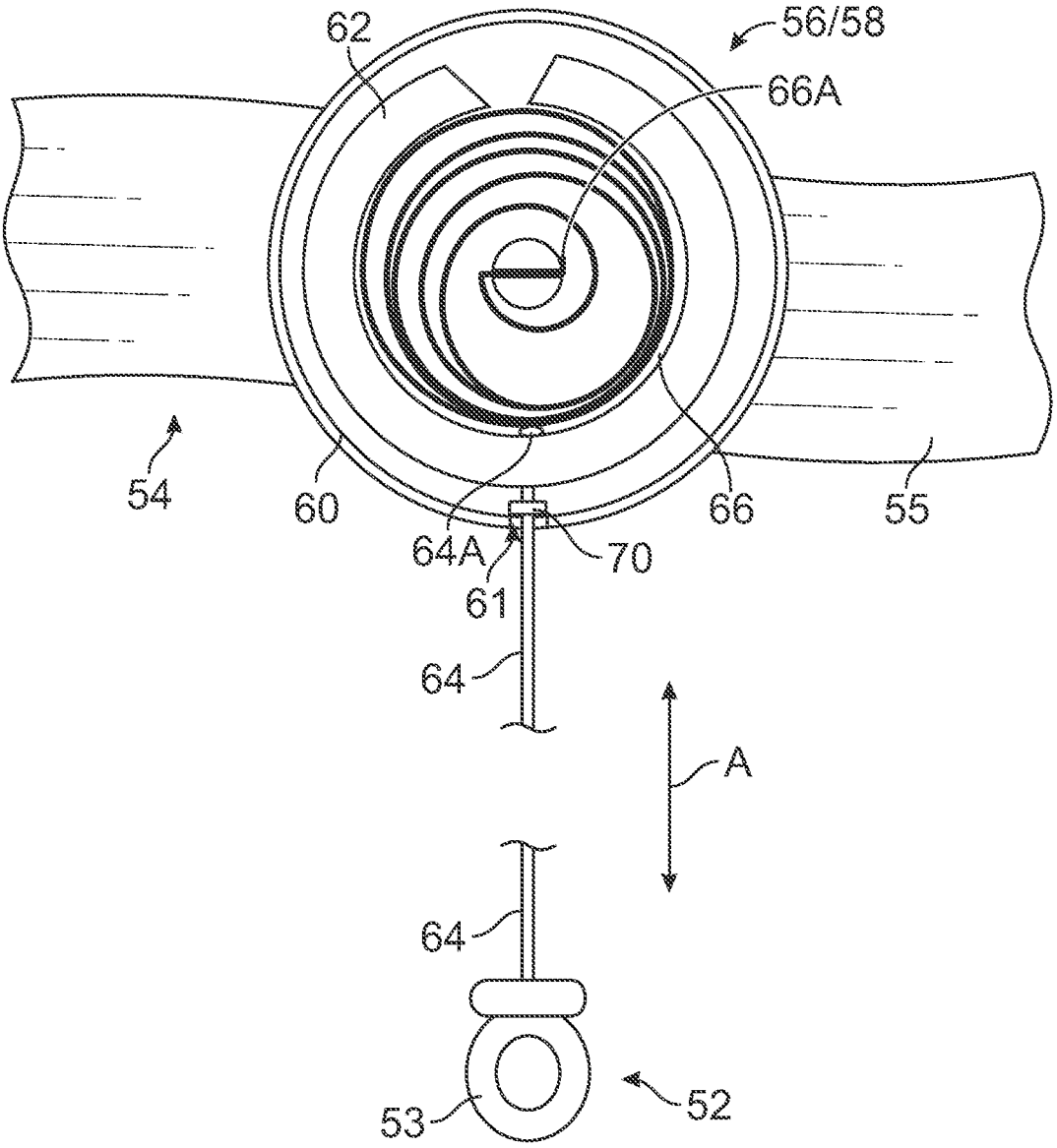
FIG. 6 is a schematic of the retractable connector of FIG. 5 in a fully or almost fully extended position.

As shown in FIGS. 5 and 6, the retractable connector 56 may comprise a pull reel 58. The pull reel 58 may include a housing 60, an inner reel 62, a cord 64, and a spring 66 (a front face of the housing 60 is removed to illustrate internal aspects of the pull reel 58). In the example shown, the spring 66 comprises a spiral torsion spring. The housing 60 comprises a spindle 68 with a slot (not labeled) that is configured to receive a first end 66A of the spring 66 and fix the first end 66A in place with respect to the housing 60. A second end (not shown) of the spring 66 may be fixedly coupled to the inner reel 62. The cord 64 may be wound or coiled around the inner reel 62 and may be received in a channel (not labeled) formed in the inner reel 62. The cord 64 may be secured at a first end 64A to the inner reel 62. For example, the first end 64A of the cord 64 may pass through an aperture (not shown) in the inner reel 62 and may form a knot that secures the cord 64 to the inner reel 62. In other examples, the first end 64A of the cord 64 may be coupled to the inner reel 62 via an adhesive, tape, etc.

A second end 64B of the cord 64 may pass through an opening 61 in the housing 60 and may be coupled to or may at least partially form the first part 52 of the fencing training device 50. For example, the first part 52 may comprise the loop 53, which may be coupled to or formed as part of a base (not labeled), and the second end 64B of the cord 64 may be coupled to or embedded in the base. The base may rest against the opening 61 and may prevent the second end 64B of the cord 64 from retracting inside the housing 60. In other examples (not shown), the first part 52 of the fencing training device 50 may comprise a section of the cord 64 that has been formed into the loop 53. The pull reel 58 may be secured to the second part 54 of the fencing training device 50. For example, a rear face (not visible) of the housing 60 may comprise a clip, hook, or other attachment that secures the pull reel 58 to the band 55. The pull reel 58 may be disposed anywhere feasible in the retractable connector 56. For instance, the pull reel 58 may be disposed at or near the first part 52 (e.g., the ankle area of the fencer) or may be disposed closer to the second part 54 of the retractable connector 56 or somewhere in between.

The retractable connector 56 is configured to extend in response to movement of one of the first or the second part 52 or 54 of the fencing training device 50 away from the other of the first or the second part 52 or 54 (i.e., one part 52/54 is substantially stationary and the other part 52/54 moves away from the substantially stationary part) or movement of the first and second parts 52 and 54 away from each other (i.e., both parts 52 and 54 move away from each other at substantially the same time), as described herein in detail. The retractable connector 56 is further configured to retract in response to movement of one of the first or the second part 52 or 54 toward the other of the first or the second part 52 or 54 (i.e., one part 52/54 is substantially stationary and the other part 52/54 moves toward the substantially stationary part) or movement of the first and second parts 52 and 54 toward each other (i.e., both parts 52 and 54 move toward each other at substantially the same time), as described herein in more detail.

For example, with reference to the pull reel 58 shown in FIGS. 5 and 6, the first and second parts 52 and 54 may move toward and away from each other, as indicated by arrow A. When the first and second parts 52 and 54 move apart, the inner reel 62 rotates about the spindle 68 and unwinds a section of the cord 64, which is pulled out of the opening 61 in the housing 60. Because the first end 66A of the spring 66 is fixed to the spindle 68 and the second end of the spring 66 is fixed to the inner reel 62, rotation of the inner reel 62 causes the spring 66 to wind, as shown in FIG. 6. When the first and second parts 52 and 54 move closer together, energy stored in the spring 66 causes the inner reel 62 to rotate in an opposite direction and rewind the cord 64 back around the inner reel 62 as the spring 66 moves back toward the position shown in FIG. 5.

The retractable connector 56 may comprise at least one stop that is configured to prevent the retractable connector 56 from extending beyond a predetermined distance, as described herein. In some examples, as shown in FIG. 6, the cord 64 may comprise a stop 70 that is fixedly coupled to the cord 64 and prevents the cord 64 from unwinding/extending beyond the predetermined distance. One or more dimensions of the stop 70 may be greater than one or more corresponding dimensions of the opening 61 of the housing 60, such that when the stop 70 engages the opening 61, the stop 70 is prevented from exiting the housing 60 and the cord 64 is prevented from unwinding/extending further. The stop 70 may be positioned at any desired location along the cord 64. In other examples, the first end 64A of the cord 64 that is secured to the inner reel 62 (e.g., the knot formed in the first end 64A and the cord 64) may serve as an alternative or additional stop that prevents the cord 64 from unwinding/extending beyond the predetermined distance.

Figure 2:
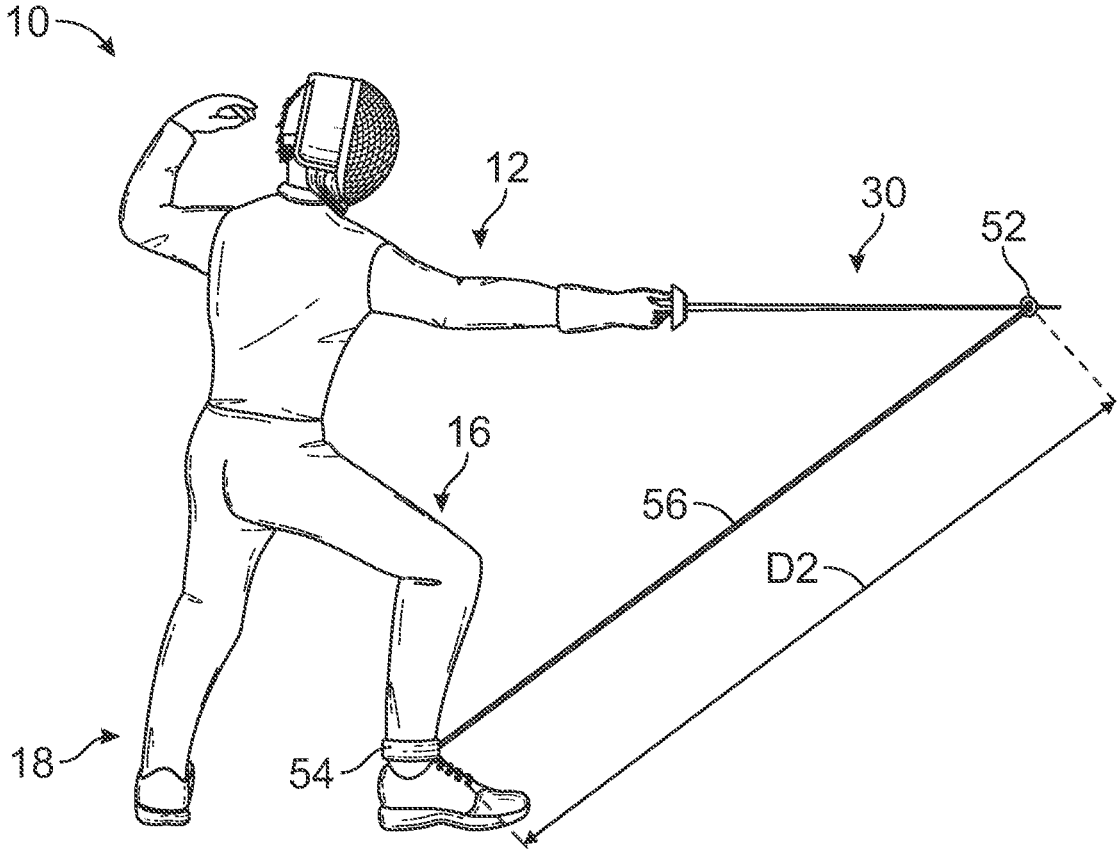
FIG. 2 is a side, perspective view of the fencer of FIG. 1 with a weapon arm extended.

With reference to FIGS. 1-4, a proper lunge sequence is depicted. The fencer 10 begins in a starting position shown in FIG. 1 with the weapon arm, i.e., the right arm 12, bent slightly at the elbow and the knees slightly bent. The first part 52 of the fencing training device 50 is coupled to the fencing weapon 30 near the tip 34, and the second part 54 is coupled to the fencer's right ankle. The retractable connector 56 is disposed between the first and second parts 52 and 54, with the first and second parts 52 and 54 being separated from each other by a first linear distance $D_1$. In FIG. 2, the fencer 10 extends the weapon arm 12 while the lower portion of the fencer's body, e.g., the legs 16 and 18, remains substantially stationary. As the fencer 10 moves from the position shown in FIG. 1 to the position shown in FIG. 2, the retractable connector 56 extends by an additional distance as the first part 52 of the fencing training device 50 moves away from the second part 54, such that the first and second parts 52 and 54 are separated from each other by a second linear distance $D_2$ that is greater than the first linear distance $D_1$.

Figure 3:
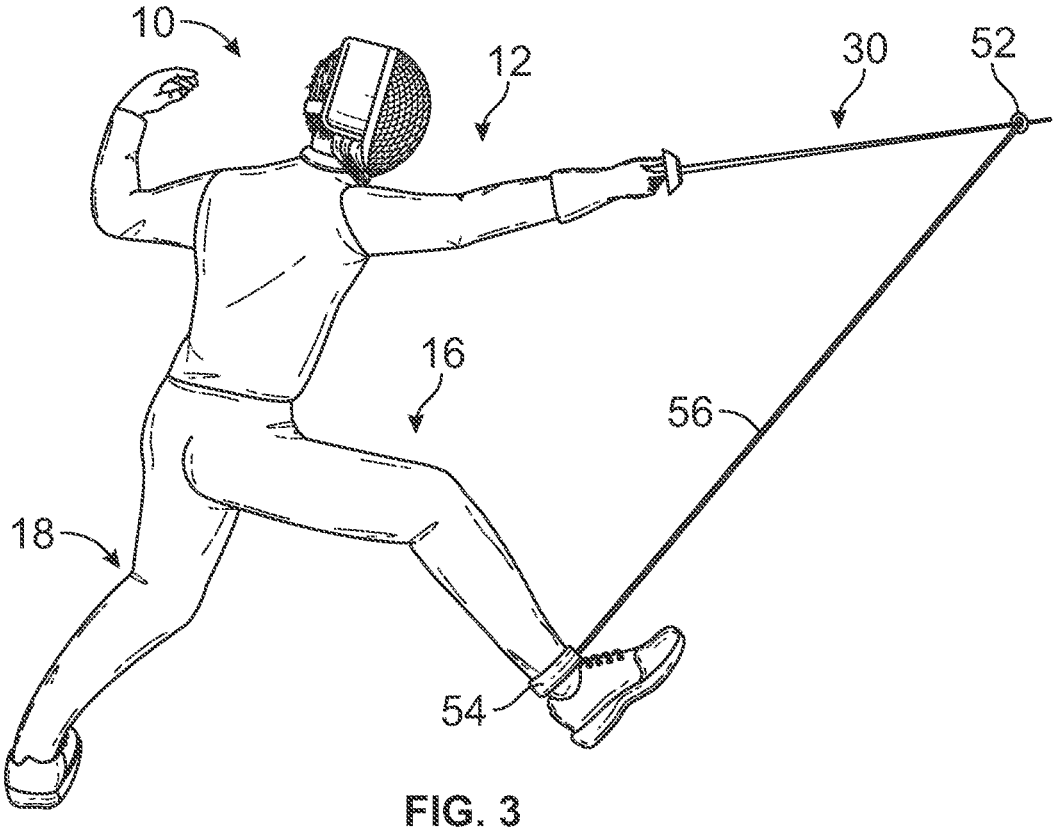
FIG. 3 is a side, perspective view of the fencer of FIG. 2 with a front leg partially extended.
Figure 4:
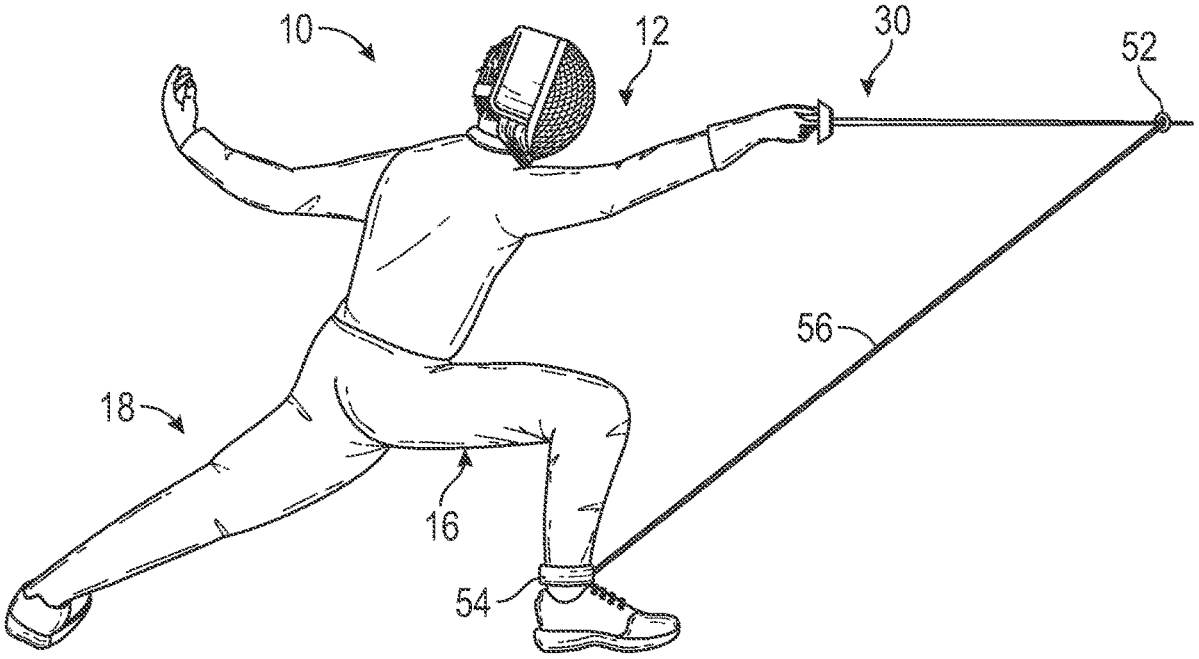
FIG. 4 is a side, perspective view of the fencer of FIG. 3 in a proper lunge stance.

As shown in FIG. 3, the fencer 10 pushes the right leg 16 (also referred to herein as a front leg) forward and kicks off from the left leg 18 (also referred to herein as an opposing leg). As shown in FIG. 4, the fencer 10 completes the lunge when the right foot 20 contacts the ground. In transitioning between the positions shown in FIGS. 1-4, the fencer's left leg 18 may shift forward as the fencer 10 leans forward and extends at the hip but the left foot 22 remains substantially stationary (e.g., the left foot 22 does not move or slides forward by a small distance but generally does not leave the ground). The fencer's weapon arm 12 and front leg 16 move together, such that the retractable connector 56 generally extends or retracts by only a small amount as the fencer 10 moves between the positions shown in FIGS. 2-4 and the linear distance (not labeled) between the first and second parts 52 and 54 of the fencing training device 50 in FIGS. 3 and 4 may remain substantially the same as the second linear distance $D_2$ depicted in FIG. 2.

With reference to the pull reel 58 illustrated in FIGS. 5 and 6, when the fencer 10 is in the position shown in FIG. 1, a length of the cord 64 corresponding to the first linear distance $D_1$ unwinds/extends from the inner reel 62, and the spring 66 winds by a corresponding amount. The spring 66 may exert a first amount of tension on the cord 64, with the cord 64 being prevented from rewinding/retracting by the connection of the first part 52 to the fencing weapon 30. When the fencer 10 extends the weapon arm 12 as shown in FIG. 2 and the first part 52 of the fencing training device 50 moves forward with the fencing weapon 30, an additional length of the cord 64 will unwind/extend, such that the cord 64 extends by an amount corresponding to the second linear distance $D_2$. The spring 66 winds by a corresponding additional amount, which may cause the spring 66 to exert a second, greater amount of tension on the cord 64. As the fencer 10 transitions to the positions shown in FIGS. 3 and 4, the linear distance (not labeled) between the first and second parts 52 and 54 of the fencing training device 50 may remain substantially the same, such that the cord 64 may unwind/extend or rewind/retract only by a small amount. The winding of the spring 66 and the tension exerted by the spring 66 on the cord 64 may also remain substantially the same.

The fencing training device 50 comprising the first and second parts 52 and 54, as shown for example in FIG. 5, may be part of a fencing training system 80 for providing feedback to a fencer regarding improper technique. The feedback may be provided based on improper extension or retraction of the retractable connector 56 and may comprise at least one of audible feedback or tactile feedback.

Figure 9:
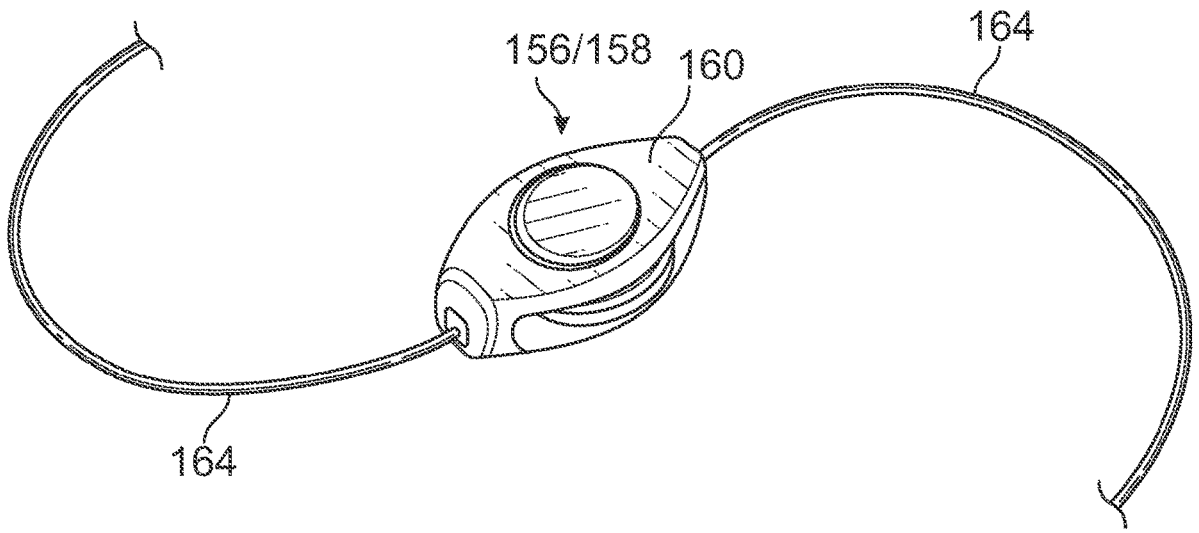
FIG. 9 is a schematic of another retractable connector in accordance with the present disclosure.

FIG. 9 is another example of a retractable connector 156 for use with a fencing training device 50 (see FIG. 1) in accordance with the present disclosure. The retractable connector 156 may comprise a double pull reel 158 with a housing 160. First and second sections of cord 164-1 and 164-2 extend from opposing ends of the housing 160. Similar to the pull reel 58 shown in FIGS. 5 and 6, each section of cord 164-1 and 164-2 may be secured at one end (not shown) to one or more inner reels (not shown) of the double pull reel 158 and at the other end (not shown) to a respective one of the first part 52 or the second part 54 of the fencing training device 50 (see FIG. 5). The sections of cord 164-1 and 164-2 may be unwind/extend and be pulled out of the housing 160 in opposing directions as the distance between the first and second parts 52 and 54 of the fencing training device 50 increases. The double pull reel 158 may comprise one or more springs (not shown) that rotate in one direction as the sections of the cord 164-1 and 164-2 unwind/extend and rotate in an opposite direction to rewind the sections of cord 164-1 and 164-2 as the distance between the first and second parts 52 and 54 decreases, as described herein with respect to the pull reel 58 in FIGS. 5 and 6.

FIGS. 1-4 and the preceding paragraphs represent a correct sequence of movements and footwork technique for performing a lunge. Beginning fencers may engage in a variety of improper movements while learning to perform the lunge and other footwork techniques. Fencing training devices and methods in accordance with the present disclosure may be used to help quickly identify and correct these improper movements.

Figure 7:
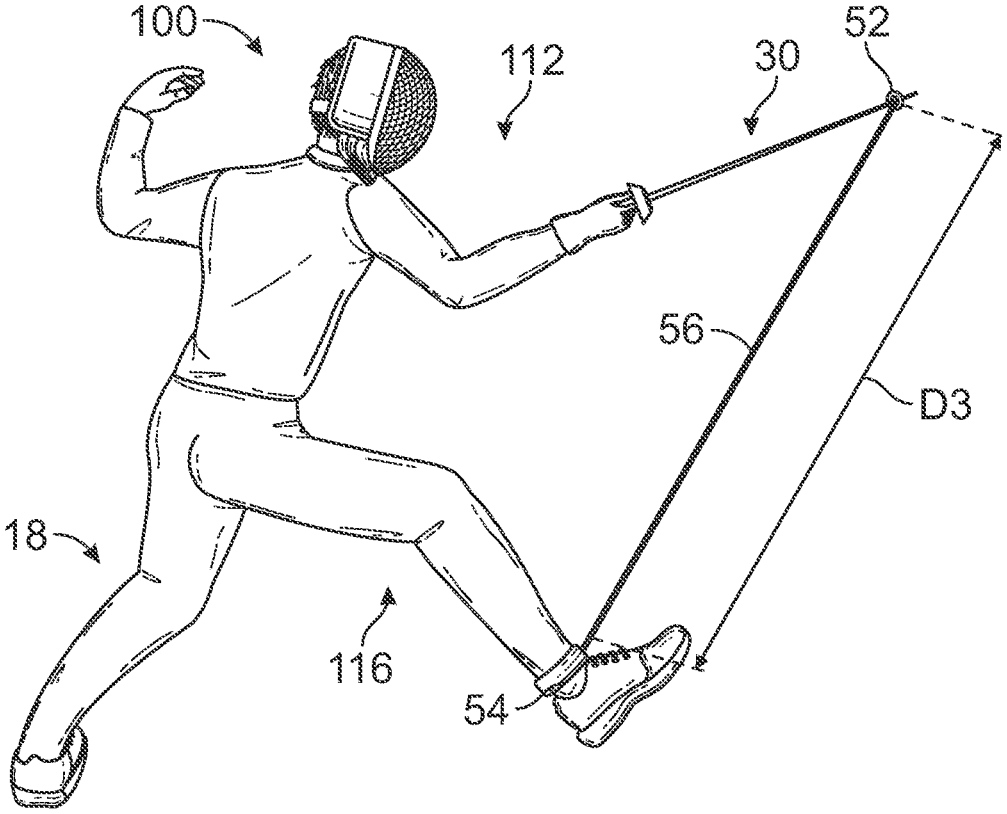
FIG. 7 is a side, perspective view of a fencer exhibiting one example of improper technique while wearing a fencing training device in accordance with the present disclosure.

For example, a fencer 100 may attempt to execute a lunge sequence using an improper technique as shown in FIG. 7. The fencer 100 may begin in the position shown in FIG. 1 but may then improperly push out the front leg 116 prior to extending the weapon arm 112, which causes the second part 54 of the fencing training device 50 to move toward the first part 52. A linear distance $D_3$ between the first and second parts 52 and 54 in FIG. 7 may become less than the linear distance $D_1$ shown in FIG. 1, such that the retractable connector 56 retracts. In another example (not shown), a fencer may move from the position shown in FIG. 1 by improperly pushing out the front leg at substantially the same time that the weapon arm is being extended. This movement may cause one or both of the first and second parts 52 and 54 of the fencing training device 50 to alternately move toward and away from each other and may cause the retractable connector 56 to correspondingly retract and extend.

The fencing training device 50 may be configured to provide feedback to the fencer 100 when the retractable connector 56 retracts due to improper technique. As described above with respect to FIGS. 2-4, the retractable connector 56 generally retracts only by a small amount when the fencer 10 engages in the proper sequence of movements, such that the linear distance between the first and second parts 52 and 54 of the fencing training device 50 remains substantially the same as the linear distance $D_2$. When the retractable connector 56 retracts (e.g., by more than a predetermined amount, such as up to about half of $D_1$) due to improper technique, the fencing training device 50 may provide one or more forms of audible feedback, e.g., clicking or beeping, and/or one or more forms of tactile feedback to the fencer 100, e.g., a reduction in tension exerted on the cord 64 by the spring 66 (see FIGS. 5 and 6) or a vibration that transmits from the retractable connector 56 to the fencer 100 via the first part 52 coupled to the fencing weapon 30 and/or the second part 54 coupled to the fencer's ankle. In this manner, the fencing training device 50 provides consistent and real-time feedback to the fencer 100, which may help the fencer 100 to more quickly identify improper technique and reinforce proper movement, i.e., leading with the weapon arm 112.

Figure 8:
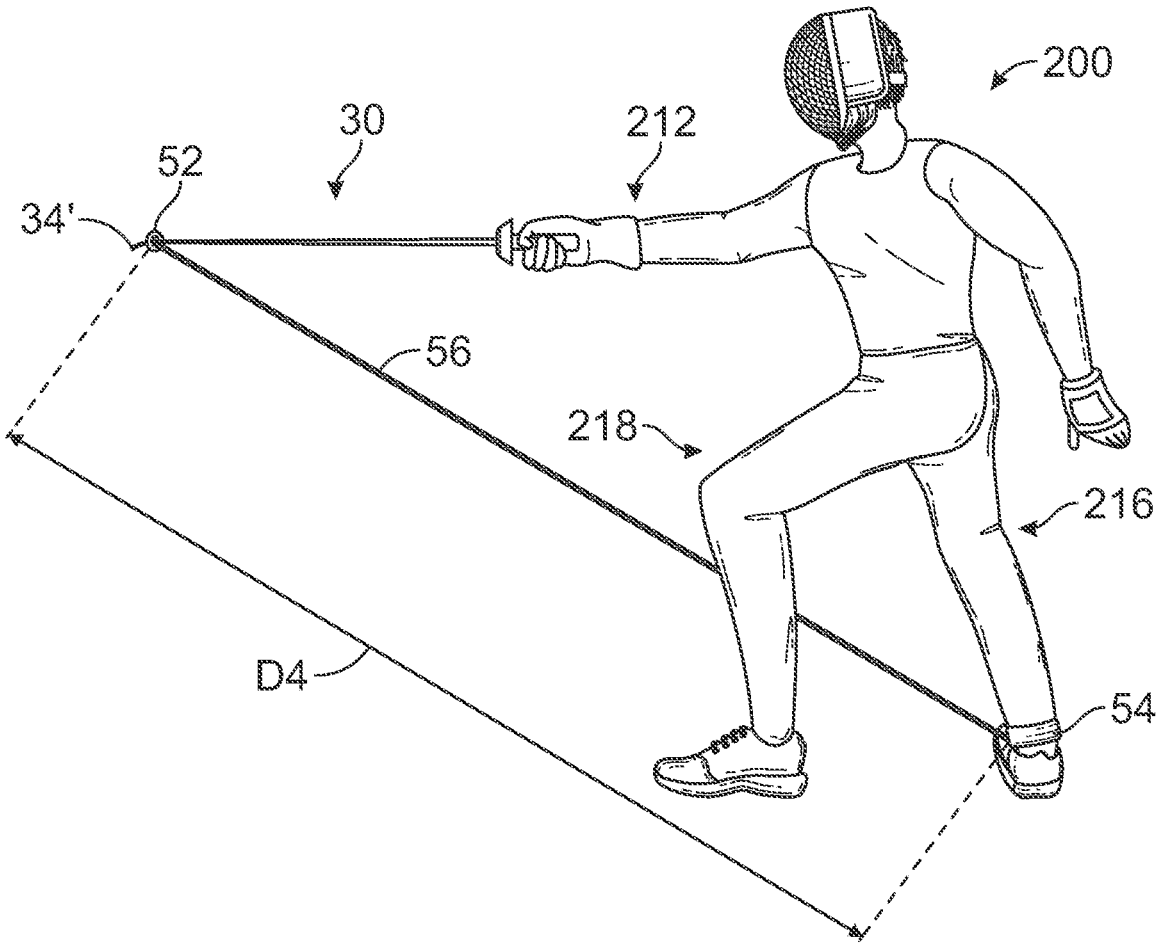
FIG. 8 is a side, perspective view of a fencer exhibiting another example of improper technique while wearing a fencing training device in accordance with the present disclosure.

FIG. 8 is a depiction of a fencer 200 exhibiting another example of improper technique, in which the weapon arm 212 is extended and the opposing leg (i.e., the left leg 218) is moved forward, but the front leg (i.e., the right leg 216) remains stationary. The fencer 200 may arrive at this stance via one or more improper movement sequences. For example, the fencer 200 may properly move from the position shown in FIG. 1 to the position shown in FIG. 2 by first extending the weapon arm 212 forward, but from this position, the fencer 200 may then improperly move the opposing leg 218 forward instead of the front leg 216. In other examples, the fencer 200 may push out the opposing leg 218 prior to the weapon arm 212 being extended or at substantially the same time that the weapon arm 212 is extended.

As described above, the linear distance between the first and second parts 52 and 54 of the fencing training device 50 remains substantially the same as the linear distance $D_2$ when the fencer engages in the proper sequence of movements. When the fencer 200 arrives at or approaches the position shown in FIG. 8, a linear distance between the first and second parts 52 and 54 may approach or exceed the linear distance $D_2$. The fencing training device 50 may be configured to prevent the retractable connector 56 from extending substantially beyond a predetermined (maximum) distance, which is depicted in FIG. 8 as linear distance $D_4$. In some examples, the linear distance $D_4$ in FIG. 8 may be substantially the same as the linear distance $D_2$ shown in FIG. 2. In other examples, the linear distance $D_4$ may be greater than the linear distance $D_2$ and less than a maximum linear distance (not shown) by which the fencer 200 could separate the first and second parts 52 and 54 of the fencing training device 50 in the absence of the retractable connector 56.

As described herein, the fencing training device 50 may comprise one or more stops that may be configured to prevent the retractable connector 56 from extending beyond the predetermined distance $D_4$. With reference to the pull reel 58 in FIGS. 5 and 6, the stop 70 and/or the stop defined by the first end 64A of the cord 64 may be configured to prevent the cord 64 from extending substantially beyond the predetermined distance $D_4$. A length of the retractable connector 56 may be configured to substantially correspond to the predetermined distance $D_4$. In some particular examples, the length of the retractable connector 56 may be configured to substantially correspond to the linear distance $D_2$ between the first and second parts 52 and 54 of the fencing training device 50 when the fencer's weapon arm 12 is fully extended and the lower portion of the fencer's body is stationary and has not yet moved, as shown in FIG. 2.

In some examples, a total length of the cord 64 may be configured to substantially correspond to the predetermined distance $D_4$, such that the attachment of the first end 64A of the cord 64 to the inner reel 62 serves as a stop. For instance, the length of the cord 64 may be configured such that the cord 64 is fully or almost fully unwound/extended when the fencer 10 is in the position shown in FIG. 2. In other examples, the stop 70 may be configured such that the cord 64 is able to extend from the housing 60 by a length that substantially corresponds to the predetermined distance $D_4$, with the stop 70 being engaged if a user attempts to extend the cord 64 beyond the predetermined distance $D_4$.

In one embodiment, $D_1$ may range from 3 feet to about 5 feet, $D_2$ may range from about 5 feet to about 6 feet, $D_3$ may range from about 4 feet to about 6 feet, and $D_4$ may be greater than about 6 feet. It is understood that the retractable connector 56 may be configured for an average user or may be configured for individual users or groups of users based on age and/or dimensions, such as height, arm length, and the like and that the cord lengths may vary according to the fencer's height, arm length, weapon, etc. It is also understood that any feasible combination of values for these distances can be configured by a coach and is contemplated in the present invention.

As the fencer 200 arrives at or approaches the position shown in FIG. 8, the fencing training device 50 may provide audible and/or tactile feedback as the fencer 200 attempts to extend the retractable connector 56 up to and/or beyond the predetermined distance $D_4$. In particular, the fencing training device 50 may cause a force to be exerted on the lower portion of the fencer's body and/or on the fencing weapon 30. For example, when one or more of the stops are engaged as described herein, a pulling force may be exerted on the fencer's right ankle via the second part 54 of the fencing training device 50 and/or on the fencing weapon 30 via the first part 52 of the fencing training device 50. In some examples, the pulling force may cause a tip 34' of the fencing weapon 30 to be deflected downward slightly, as shown in FIG. 8. This pulling force provides real-time feedback to the fencer 200, which may help the fencer 200 to more quickly identify incorrect footwork and learn to engage in proper technique, i.e., extending the arm and leg on the same side of the body. In other examples, the fencing training device 50 may provide one or more forms of audible feedback, e.g., clicking or beeping, as the fencer 200 attempts to extend the retractable connector 56 up to and/or beyond the predetermined distance $D_4$.

Figure 10:
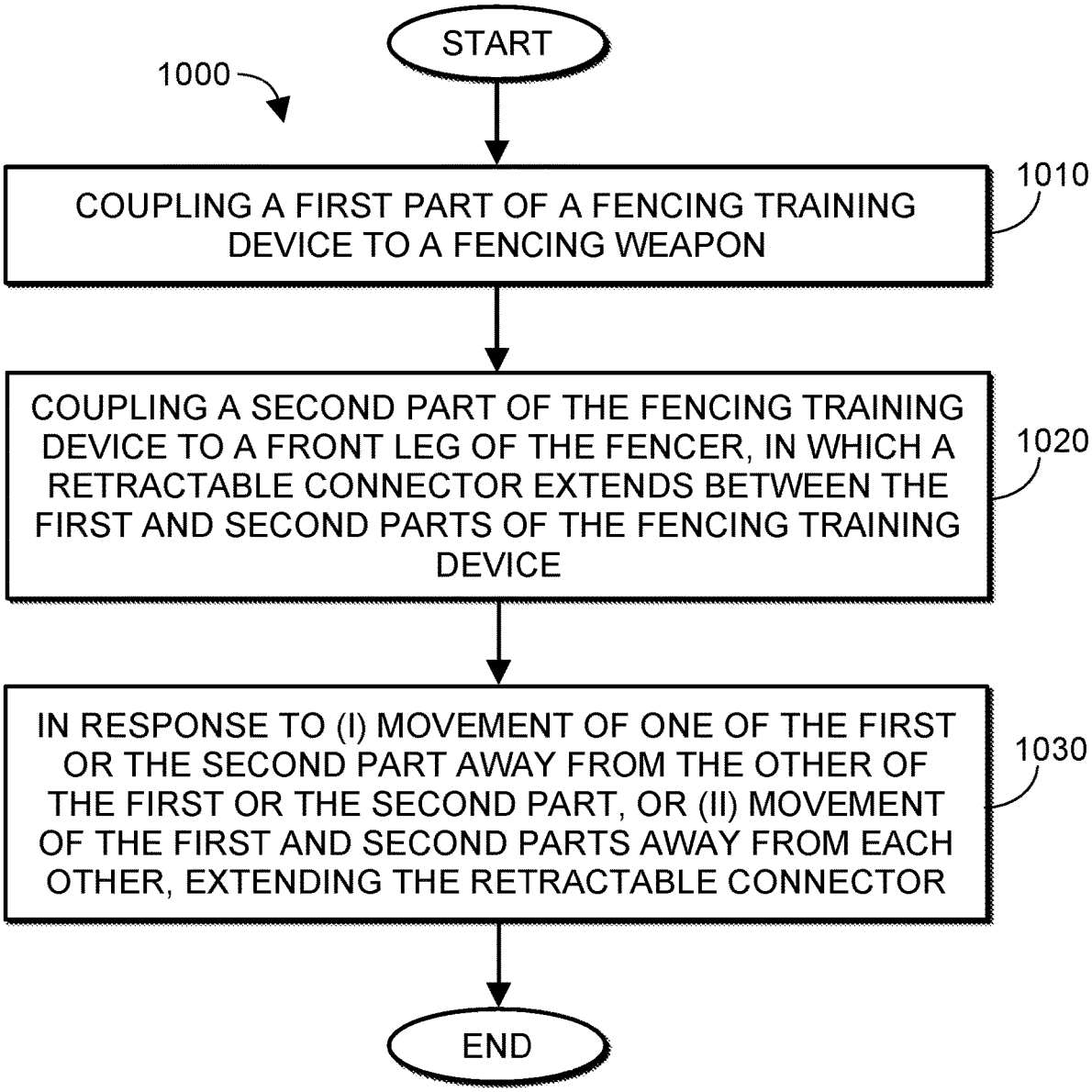
FIG. 10 is a flow diagram illustrating an exemplary method of training a fencer to perform a lunge in accordance with the present disclosure.

FIG. 10 is a flowchart illustrating a method 1000 of training a fencer to perform a fencing technique such as a lunge. The method 1000 begins at Step 1010 with coupling a first part of a fencing training device to a fencing weapon. At Step 1020, a second part of the fencing training device is coupled to a front leg of the fencer, in which a retractable connector is disposed between the first and second parts and of the fencing training device. In response to movement of one of the first or the second part away from the other of the first or the second part or movement of the first and second parts away from each other, the retractable connector extends at Step 1030, after which the method may conclude.

As described herein, the retractable connector may extend as a weapon arm of the fencer extends and the front leg of the fencer remains stationary, in which the weapon arm and the front leg are located on a same side of the fencer's body, i.e., the right side as shown in FIG. 1 or the left side (not shown). A length of the retractable connector may be configured to correspond to a particular linear distance. For example, with reference to FIG. 2, the length of the retractable connector may be configured to correspond to the second linear distance $D_2$ between the first and second parts of the fencing training device when a fencer's weapon arm is fully extended. Also as described herein, a stop (e.g., the stop 70 or the first end 64A of the cord 64 in FIG. 6) may be engaged, in which the stop is configured to prevent the retractable connector from extending beyond a predetermined distance. The stop may be engaged, for example, when the front leg of the fencer remains stationary and an opposing leg of the fencer moves forward (see FIG. 8). When the stop is engaged, the fencing training device may provide one or more forms of feedback. For example, a force may be exerted on the front leg of the fencer and/or the fencing weapon. In response to movement of one of the first or the second part of the fencing training device toward the other of the first or the second part or movement of the first and second parts of the fencing training device toward each other, the retractable connector may retract, as described herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." In addition, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fencing training device comprising:

a fencing weapon comprising a sword with a blade;

a first part configured to be coupled to the fencing weapon at a forward section of the blade;

a second part configured to be coupled to a lower portion of a fencer's body; and a retractable connector disposed between the first and second parts.

2. The fencing training device of claim 1, wherein the retractable connector is configured to:

extend in response to (i) movement of one of the first or the second part away from the other of the first or the second part, or (ii) movement of the first and second parts away from each other; and retract in response to (i) movement of one of the first or the second part toward the other of the first or the second part, or (ii) movement of the first and second parts toward each other.

3. The fencing training device of claim 2, wherein a length of the retractable connector is configured to substantially correspond to a linear distance between the first and second parts of the fencing training device when a fencer's weapon arm is fully extended and the lower portion of the fencer's body is stationary.

4. The fencing training device of claim 2, further comprising a stop that is configured to prevent the retractable connector from extending beyond a predetermined distance.

5. The fencing training device of claim 1, wherein the blade comprises a tip and the first part is configured to be coupled to the blade at or near the tip.

6. The fencing training device of claim 1, wherein the lower portion of the fencer's body comprises a leg portion.

7. The fencing training device of claim 6, wherein a fencer's weapon arm and the fencer's leg portion are located on a same side of the fencer's body.

8. The fencing training device of claim 1, wherein the retractable connector comprises a pull reel with a cord.

9. A method of training a fencer to perform a lunge, the method comprising:

coupling a first part of a fencing training device to a fencing weapon, comprising a sword with a blade; wherein the first part of the fencing training device is coupled to a forward section of the blade;

coupling a second part of the fencing training device to a front leg of the fencer, wherein a retractable connector is disposed between the first and second parts of the fencing training device; and in response to (i) movement of one of the first or the second part away from the other of the first or the second part, or (ii) movement of the first and second parts away from each other, extending the retractable connector.

10. The method of claim 9, wherein the retractable connector extends as a weapon arm of the fencer extends and the front leg of the fencer remains stationary, the weapon arm and the front leg being located on a same side of a body of the fencer.

11. The method of claim 9, further comprising:

engaging a stop that is configured to prevent the retractable connector from extending beyond a predetermined distance.

12. The method of claim 11, wherein the stop is engaged when the front leg of the fencer remains stationary and an opposing leg of the fencer moves forward.

13. The method of claim 11, further comprising:

when the stop is engaged, exerting a force on one or both of the front leg of the fencer and the fencing weapon.

14. The method of claim 9, further comprising:

in response to (i) movement of one of the first or the second part toward the other of the first or the second part, or (ii) movement of the first and second parts toward each other, retracting the retractable connector.

15. The method of claim 9, wherein a length of the retractable connector is configured to correspond to a linear distance between the first and second parts of the fencing training device when a fencer's weapon arm is fully extended.

16. The method of claim 9, wherein the retractable connector comprises a pull reel with a cord.

17. A fencing training system for providing feedback to a fencer regarding improper technique, the system comprising:

a fencing weapon comprising a sword with a blade;

a first part configured to be coupled to the fencing weapon at a forward section of the blade;

a second part configured to be coupled to a lower portion of a fencer; and a retractable connector disposed between the first and second parts, wherein the fencing training system provides the feedback based on improper extension or retraction of the retractable connector.

18. The fencing training system of claim 17, wherein the feedback comprises at least one of audible feedback or tactile feedback.

* * * * *